US007373100B2

(12) United States Patent
Hamada et al.

(10) Patent No.: US 7,373,100 B2
(45) Date of Patent: May 13, 2008

(54) COLOR IMAGE FORMING APPARATUS HAVING PRE-TRANSFER DISCHARGE ELECTRODE

(75) Inventors: Shuta Hamada, deceased, late of Hachioji (JP); by Akira Hamada, legal representative, Hyogo (JP); by Yoshiko Hamada, legal representative, Hyogo (JP); Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 322 days.

(21) Appl. No.: 11/304,251

(22) Filed: Dec. 14, 2005

(65) Prior Publication Data

US 2006/0198665 A1 Sep. 7, 2006

(30) Foreign Application Priority Data

Mar. 3, 2005 (JP) ..... 2005-058628
Mar. 16, 2005 (JP) ..... 2005-075015

(51) Int. Cl.
*G03G 15/16* (2006.01)

(52) U.S. Cl. ..... 399/296

(58) Field of Classification Search ..... 399/31, 399/44, 128, 296, 302, 308
See application file for complete search history.

(56) References Cited

U.S. PATENT DOCUMENTS

| | | | | |
|---|---|---|---|---|
| 5,701,569 | A * | 12/1997 | Kanazawa et al. | 399/308 |
| 5,864,737 | A * | 1/1999 | Obu et al. | 399/176 |
| 6,952,539 | B2 * | 10/2005 | Matsuura | 399/66 |
| 7,013,105 | B2 * | 3/2006 | Omata | 399/296 |
| 7,308,212 | B2 * | 12/2007 | Hamada et al. | 399/49 |
| 2003/0123910 | A1 * | 7/2003 | Kim et al. | 399/296 |
| 2006/0153601 | A1 * | 7/2006 | Hamada et al. | 399/296 |
| 2006/0198647 | A1 * | 9/2006 | Hamada et al. | 399/49 |

FOREIGN PATENT DOCUMENTS

| | | | |
|---|---|---|---|
| JP | 10-274892 | | 10/1998 |
| JP | 11-143255 | | 5/1999 |
| JP | 11258923 | A * | 9/1999 |
| JP | 2000131971 | A * | 5/2000 |
| JP | 2001331046 | A * | 11/2001 |
| JP | 2003-057959 | | 2/2003 |
| JP | 2004069860 | A * | 3/2004 |

* cited by examiner

*Primary Examiner*—Robert Beatty
(74) *Attorney, Agent, or Firm*—Cantor Colburn LLP

(57) ABSTRACT

A color image forming apparatus may have an image forming unit composed of a plurality of groups which have image carriers and image forming devices.

21 Claims, 6 Drawing Sheets

COLOR IMAGE FORMING APPARATUS HAVING PRE-TRANSFER DISCHARGE ELECTRODE

This application is based on Japanese Patent Application No. 2005-058628 filed on Mar. 3, 2005, and No. 2005-075015 filed on Mar. 16, 2005, in Japanese Patent Office, the entire content of which is hereby incorporated by reference.

TECHNICAL FIELD

The present invention relates to an image forming apparatus of an electrophotographic type, such as a copy apparatus, a printer, or a facsimile apparatus, and more particularly, relates to an image forming apparatus using an intermediate transfer member.

BACKGROUND

Heretofore, a color image forming apparatus of an electrophotographic type using an intermediate transfer belt has been known. The color image forming apparatus transfers a toner image formed on an image carrier which is a photoconductor, onto an intermediate transfer member (such as an intermediate transfer belt), and transfers this toner image on the intermediate transfer member onto a transfer material (also called a recording paper or sheet). In other words, the apparatus transfers the toner image which is charged to a predetermined polarity and formed on the photoconductor, onto the intermediate transfer belt using electrostatic force, and then transfers this toner image on the intermediate transfer belt onto the transfer material using electrostatic force. With such a color image forming apparatus, the toner charge amount on the intermediate transfer member may vary depending on the number of primary transfers or environmental conditions, so that various image defects are likely to occur in the secondary transfer to the transfer material from the intermediate transfer member holding the toner image with the charge amount widely dispersed.

Such an image forming apparatus using the intermediate transfer belt is broadly used as a color image forming apparatus, because the apparatus can sequentially superimpose individual toner images formed on the photoconductor onto the intermediate transfer belt, and can further transfer the superimposed toner image onto the transfer material in batch.

In this color image forming apparatus, it is difficult to obtain a high quality image due to the secondary transfer failure in the secondary color (or more), even though the secondary transfer performance is good in the primary color. This is because the toner charge amount on the intermediate transfer belt varies depending on the number of primary transfers, environment or other conditions, various image defects are likely to occur in the secondary transfer from the intermediate transfer belt to the transfer material.

To cope with the above disadvantage, there is proposed a technology, for the purpose of correcting the charge amount of the toner image, that charges the toner image which is primarily transferred onto the intermediate transfer belt by corona discharge in an pre-secondary-transfer electricity removal unit of AC, DC and the like, to equalize the toner charge amount (see, for example, Patent Documents 1, 2, and 3).

Further, in order to prevent such failures as density irregularities due to the lack of transfer charge that occurs when the toner adhering amount is large and the toner layer potential is high and a discharge in the transfer charge increased, a technology for applying an electricity removal processing to the toner image on the intermediate transfer belt before the secondary transfer is also proposed.

[Patent Document 1] Japanese Patent Publication Laid-Open No. HEI 10-274892

[Patent Document 2] Japanese Patent Publication Laid-Open No. HEI 11-143255

[Patent Document 3] Japanese Patent Publication Laid-Open No. 2003-57959

In Patent Documents 1 and 2, the charge amount of the toner on the intermediate transfer member is equalized at a larger value, so that when the environmental humidity is low or the secondary transfer is carried out onto a transfer material having a high resistance value such as heavy paper, image defects are likely to occur in the discharge due to the potential increase in the transfer material, and when the transfer voltage is suppressed to prevent such image defects, a portion in which the total charge in the toner layer is large becomes deficient in the transfer electric field, thereby the density irregularities and toner scattering toward around the image will occur.

Thus, in order to prevent the density irregularities due to the lack of the transfer charge occurring with a large amount of adhering toner, the discharge in the charge increased and other related failures, it is conceivable to carry out the electricity removal from the toner image on the intermediate transfer member before the secondary transfer.

However, in a case in which a plurality of levels are provided for the system speed depending on the thickness of the transfer material and other factors, the electricity removal efficient of the toner image on the intermediate transfer belt varies depending on the speed of the intermediate transfer belt, and this causes a problem of insufficient electricity removal, over electricity removal and the like, particularly, relative to the image portion having a large amount of adhering toner.

Further, the electricity removal efficiency of the toner layer charge varies depending on the operational environment surrounding the apparatus, so that the toner charge amount after the removal of electricity also varies, thereby causing a problem that it is difficult to obtain a better toner charge amount for the secondary transfer.

SUMMARY

There is a need to provide an image forming apparatus capable of realizing a stable image forming, by preventing the problem in the secondary transfer as descried above, and by allowing a bias setting in the pre-secondary-transfer electricity removal by which the best secondary transfer is carried out, when the system speed or the environment is changed, in accordance with the changed condition.

The present invention has the following features.

A color image forming apparatus has: an image forming unit composed of a plurality of groups which have image carriers and image forming devices, wherein the image forming device provided around the image carrier forms a toner image on the image carrier; an intermediate transfer member which is surrounded by the plurality of groups; a primary transfer unit for transferring the toner image on the image carrier onto the intermediate transfer member to form an superimposed toner image; a secondary transfer unit which is provided at the downstream of the intermediate transfer member from the primary transfer unit, and transfers the superimposed toner image onto a transfer material; an electricity removal unit which has a discharge electrode and a grid electrode, and is provided between the primary transfer unit and the secondary transfer unit; a discharge electrode power source for applying a DC voltage with reverse polarity to the toner image on the intermediate transfer member to the discharge electrode; a grid electrode power source for applying a DC voltage with the same polarity as the toner image on the intermediate transfer member to the grid electrode; a counter electrode which is provided facing the electricity removal unit; a current detecting unit for detecting an electricity removal current flowing through the counter electrode, and a control unit for controlling an output of the electricity removal unit in accordance with a value of the electricity removal current detected by the current detecting unit.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which.

DESCRIPTION OF PREFERRED EMBODIMENT

The present embodiment is configured as follows.

Item 1: A color image forming apparatus has a control unit that is provided with a plurality of groups of image forming devices, placed along an intermediate transfer member, for forming toner images on image carriers by providing image forming devices around the image carriers, transfers the toner images formed in the individual image forming sections so as to superimpose the toner images onto the intermediate transfer member by a primary transfer unit, and transfers the superimposed toner image by a secondary transfer unit on which a bias voltage is applied onto transfer material in batch, wherein the color image forming apparatus is provided with an electricity removal unit of a scorotron type having the grid function between the primary transfer unit along the intermediate transfer member and the secondary transfer unit positioned in the downstream side thereof, applying a DC voltage with reverse polarity to the toner to a discharge electrode of the electricity removal unit, and also applying a DC voltage with the same polarity as the toner to the grid, and is provided with a detection unit for detecting an electric current for electricity removal flowing toward the counter electrode of the electricity removal unit, thereby controlling the applied voltage to be applied to the discharge electrode in accordance with the detected current for electric removal.

Item 2: The color image forming apparatus according to Item 1 has an adjustment mode for adjusting the electricity removal before secondary transfer, wherein the adjustment mode sets the applied voltage to be applied to the discharge electrode from the electric current value for electricity removal of a toner image for testing.

Item 3: The color image forming apparatus according to Item 2, when changing the process speed of the color image forming apparatus, carries out the adjustment of electricity removal before secondary transfer by the adjustment mode.

Item 4: The color image forming apparatus according to Item 2 further has a hygrometer, wherein the control unit is storing the humidity in the previous adjustment of electricity removal before secondary transfer, and urges again the adjustment of electricity removal before secondary transfer when the humidity detected by the hygrometer is larger than a predetermined humidity difference.

First of all, the image forming apparatus to which the pre-secondary-transfer electricity removal unit according to the present embodiment is mounted will be described.

The description in the embodiment is not intended to limit the technical scope of the embodiment by the terms used in this specification. It is to be noted that the present embodiment is not limited to the embodiments described below.

First Embodiment

Figure 1:
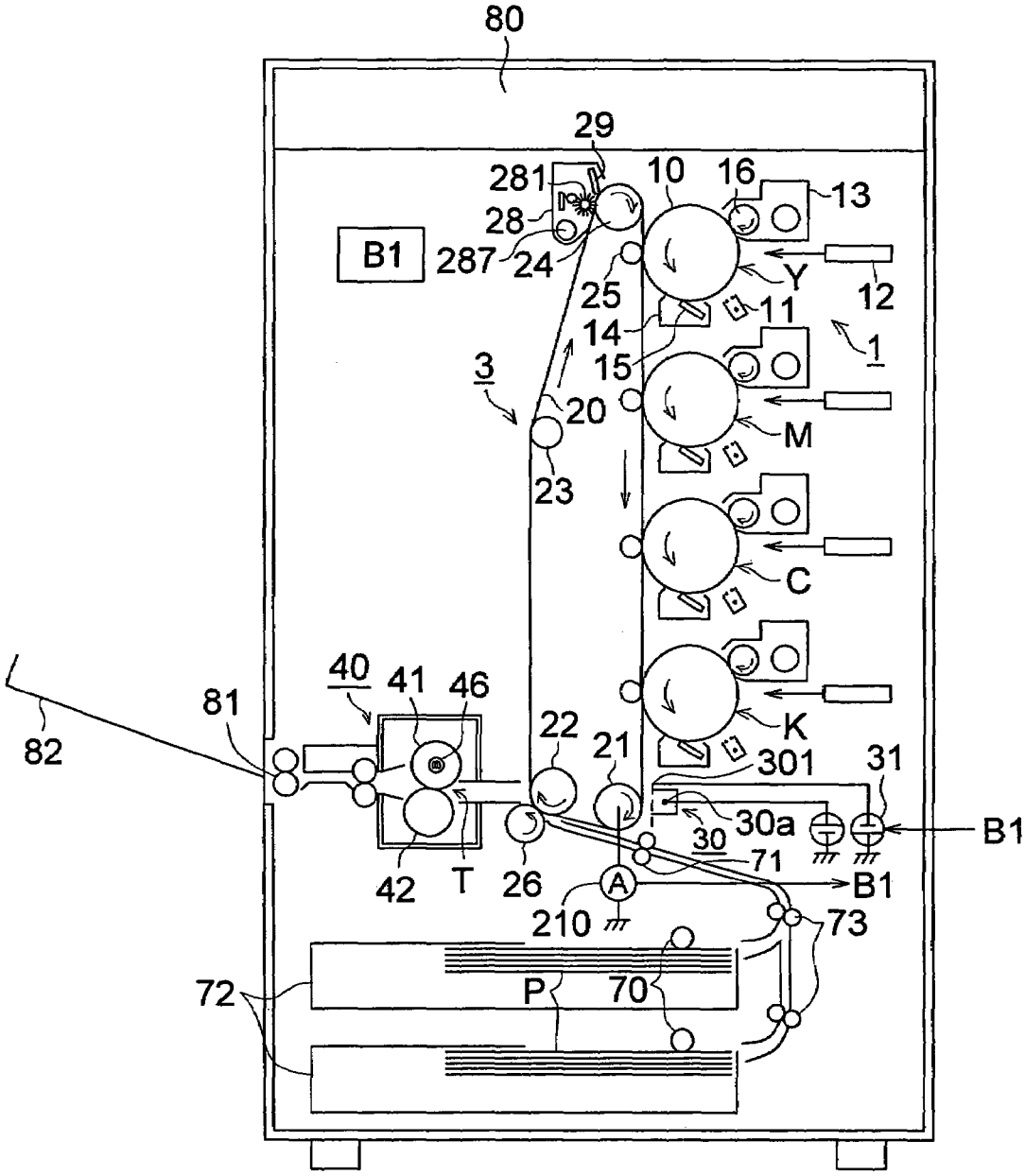
FIG. 1 is a schematic view showing an example of the general configuration of an image forming apparatus.

FIG. 1 is a schematic view showing an example of the general configuration of an image forming apparatus.

In FIG. 1, reference numeral 10 denotes a photoconductor, reference numeral 11 denotes a scorotron charger which is a charging section, reference numeral 12 denotes a writing device which is a writing section, reference numeral 13 denotes a development device which is a development section, reference numeral 14 denotes a cleaning device for cleaning a surface of the photoconductor 10, reference numeral 15 denotes a cleaning blade, reference numeral 16 denotes a developing sleeve. And an intermediate transfer member is used. In this embodiment, an intermediate transfer member is a belt denoted reference numeral 20. An image forming unit 1 is composed of the photoconductor 10, the scorotron charger 11, the development device 13, the cleaning device 14 and other related components, and the mechanical configuration of the image forming unit 1 for each color is the same, so that the reference numerals are assigned to the components of only the Y (yellow) line, and the reference numerals for the components of the M (magenta), C (cyan) and K (black) lines are omitted therefrom.

The image forming units 1 for each of the colors are arranged in order from Y, M, C, and K, relative to the travel direction of the intermediate transfer belt 20, wherein each photoconductor 10 contacts a stretched surface of the intermediate transfer belt 20 to rotate at a contact point in the same direction as the travel direction of the intermediate transfer belt 20 and at the same linear velocity.

The intermediate transfer belt 20 is extended among a drive roller 21, an earth roller 22, a tension roller 23, an electricity removal roller 27, and a driven roller 24, wherein a belt unit 3 is composed of these rollers and the intermediate transfer belt 20, a primary transfer roller 25, and a cleaning device 28 and the like.

The travel of the intermediate transfer belt 20 is carried out by the rotation of the drive roller 21 by a drive motor not shown.

Generally, in the case in which a velocity difference is provided between the photoconductor 10 and the intermediate transfer belt 20 (photoconductor>intermediate transfer belt) in order to increase the transfer efficiency, driving the belt by a roller between the first transfer and the second transfer is unlikely to cause the belt deflection, and thereby is advantageous to reduce the velocity fluctuation of the belt.

The photoconductor 10 has a light sensitive layer, for example, such as an electrically conductive layer, an a-Si layer or an organic photoconductor (OPC) which is formed on the periphery of a cylindrical metal substrate formed of an aluminum material, and rotates in the counterclockwise direction indicated by the arrow of FIG. 1 in the state in which the electrically conductive layer is grounded.

Electrical signals corresponding to the image data from a reading device 80 are converted into optical signals by an image forming laser, and are projected onto the photoconductor 10 by the writing device 12.

The development device 13 has the developing sleeve 16 that maintains a predetermined interval relative to the circumferential surface of the photoconductor 10 and is formed by a cylindrical non-magnetic stainless or aluminum material rotating in the reverse direction at a position closest to the rotation direction of the photoconductor 10.

The intermediate transfer belt 20 is an endless belt with a volume resistivity of $10^6$ to $10^{12}$ Ω·cm, which is, for example, a seamless belt of a semiconducting material with a thickness of 0.04 to 0.10 mm, in which the conductive material is dispersed in an engineering plastic such as modified polyimide, thermoset polyimide, ethylene tetrafluoroethylene copolymer, polyvinylidene fluoride, or nylon alloy.

The primary transfer roller 25 is applied with the DC voltage with reverse polarity (straight polarity in the embodiment) to the toner (negative polarity in the embodiment), and has the function of causing the toner image formed on the photoconductor 10 to be transferred onto the intermediate transfer belt 20.

Reference numeral 26 denotes a secondary transfer roller capable of coming into contact with and releasing contact from the earth roller 22, wherein the secondary transfer roller is applied with the voltage with reverse polarity to the toner and retransfers the toner image formed on the intermediate transfer belt 20 onto a transfer material P.

Reference numeral 28 denotes a cleaning device placed facing the driven roller 24 with the intermediate transfer belt 20 therebetween. In the intermediate transfer belt 20, after the toner image has been transferred onto the transfer material P, the electric charge of the residual toner is reduced by the electricity removal roller 27 applied with an AC voltage, on which the DC voltage with the same polarity as or reverse polarity to the toner is superimposed, and the toner remaining on the circumferential surface thereof is cleaned by the brush roller 281 of the cleaning device 28 and the cleaning blade 29.

Reference numeral 30 denotes an electricity removal unit which is a pre-secondary-transfer electricity removal section according to the embodiment, provided at a position opposite to the drive roller 21 serving as the counter electrode and the belt roller at the same time, via the intermediate transfer belt.

Reference numeral 70 denotes paper feeding rollers, reference numeral 71 denotes timing rollers, reference numeral 72 denotes paper cassettes, and reference numeral 73 denotes conveyance rollers. Reference numeral 81 denotes paper delivery rollers that deliver the transfer material on which the toner image is fixed to a delivery tray 82.

Reference numeral 40 denotes a fixing device composed of a heat roller 41 heated by a halogen lamp 46 and a pressure roller 42 pressurized by a pressure mechanism not shown, wherein the fixing device picks the transfer material carrying the toner image by a nip T to pressurize and fix the toner image.

Reference numeral B1 denotes a control part which is a control section for controlling the drive units, image forming process, fixing temperature, and the electric charge of the superimposed toner image on the intermediate transfer belt before the secondary transfer according to the embodiment.

Next, the image forming process will be described based on FIG. 1.

At the start of the image recording, the photoconductor 10 of the color signal Y is rotated in the counterclockwise direction indicated by the arrow by the start of a photoconductor drive motor not shown, and at the same time, a potential grant to the photoconductor 10 is started by the charging action of the scorotron charger 11.

After the photoconductor 10 was granted with the electric potential, an image corresponding to the image data of Y is started to be written by the writing device 12 to form an electrostatic latent image corresponding to the image of Y in the document image onto the surface of the photoconductor 10.

The electrostatic latent image is reversely developed by the development device 13 in the non-contact state, and the toner image of Y is formed onto the photoconductor 10 in accordance with the rotation of the photoconductor 10.

The toner image of Y formed on the photoconductor 10 is primarily transferred onto the intermediate transfer belt 20 by the action of the transfer roller 25 of Y.

Then, the residual toner is cleaned off by the cleaning blade 15, and the photoconductor 10 enters the next image forming cycle (the cleaning process is the same as in M, C, K and the description will be omitted hereinafter).

Next, an image corresponding to the image data of the color signal M (magenta), namely an image data of M, is written by the wiring device 12, and an electrostatic latent image corresponding to the image of M in the document image is formed on the surface of the photoconductor 10. The electrostatic latent image is made as the toner image of M on the photoconductor 10 by the development device 13 of M, and is synchronized with the toner image of Y on the intermediate transfer belt 20 in the transfer roller 25 of M, and then is superimposed and primarily transferred onto the toner image of Y.

With the same process as described above, a toner image of C (cyan) is synchronized with the superimposed toner image of Y and M, and primarily transferred by superimposing onto the superimposed toner image of Y and M in the transfer roller 25 of C. Next, a toner image of K is synchronized with the superimposed toner image of Y, M and C that has been already formed, and the toner image of K is primarily transferred by superimposing onto the superimposed toner image of Y, M, C, thereby to form a superimposed toner image of Y, M, C and K. Then, the electricity in the superimposed toner image of Y, M, C, K is removed in the pre-secondary-transfer electricity removal unit, with the drive roller 21 as the counter polarity.

The intermediate transfer belt 20, on which the superimposed toner image with at least two or more colors is carried, is sent in the clockwise direction as shown in the arrow, wherein the transfer material P is fed out by the paper feeding roller 70 from the paper cassette 72, conveyed to the timing roller 71 via the conveyance roller 73 and temporarily stops therein, synchronized with the superimposed toner image on the intermediate transfer belt 20 by the drive of the timing roller 71, and is fed to a transfer area S of the transfer roller 26 (in the state of coming into contact with the intermediate transfer belt 20) to which the DC voltage with reverse polarity to the toner is applied, thereby the superimposed toner image on the intermediate transfer belt 20 is secondarily transferred onto the transfer material P.

Then, as the intermediate transfer belt 20 travels, the electric charge of the residual toner is reduced by the electricity removal roller 27 and the remaining toner on the belt is cleaned off by the cleaning device 28, and then the intermediate transfer belt 20 enters the next image forming cycle.

The scraped off toner is accumulated within the cleaning device 28, conveyed in the axial direction by the rotation of a conveyance screw 287 (in the direction from the paper front side to the back side in the figure), and is accumulated in an accumulation box via a disposal tube not shown.

The transfer material P on which the superimposed toner image is transferred is further fed to the fixing device 40, held between the heat roller 41 and the pressure roller 42, and is pressurized to fix the image thereon. The transfer material P on which the toner image is fixed is conveyed to the delivery tray 82 by the delivery rollers 81.

Figure 2:
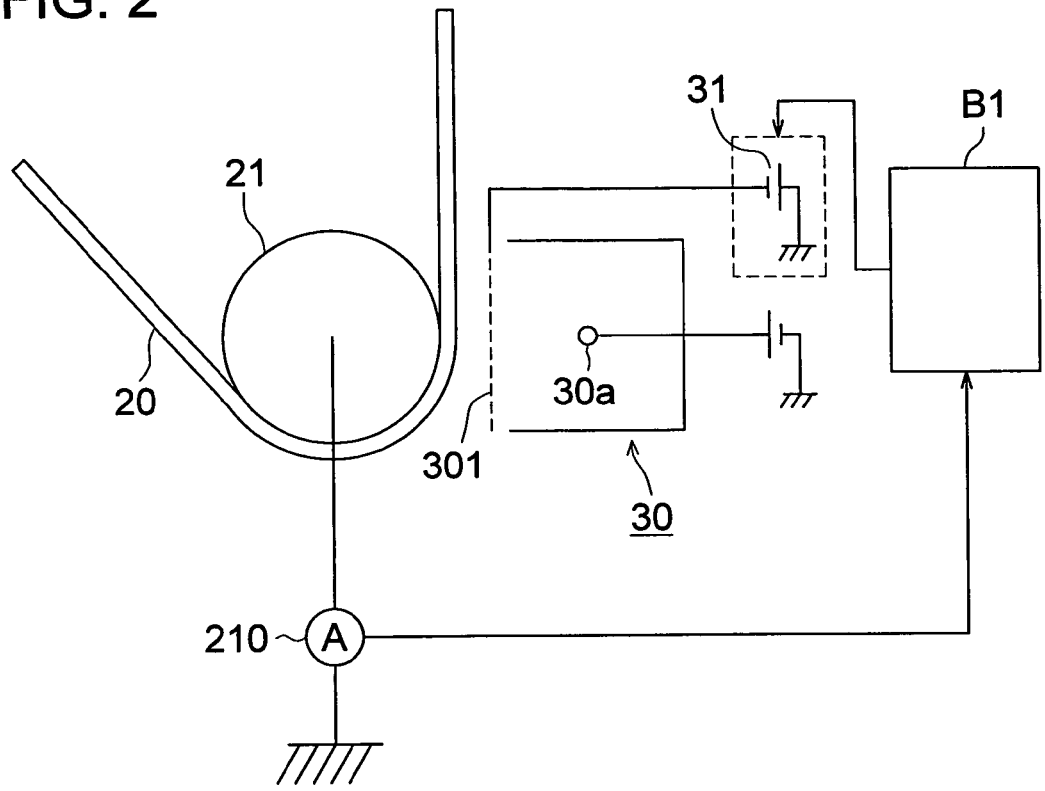
FIG. 2 is an enlarged view of the vicinity of a pre-secondary-transfer electricity removal unit and a drive roller.

FIG. 2 is an enlarged view of the vicinity of the pre-secondary-transfer electricity removal unit and the drive roller according to the embodiment.

As described above, the electricity removal efficiency of the toner layer electric charge widely varies due to the variation in the system speed and the operational environment of the apparatus, so that the toner charge amount after removal of electricity varies, thereby causing a problem that it is difficult to obtain a better toner charge amount relative to the secondary transfer.

In order to prevent the above problem, the present embodiment provides a pre-secondary-transfer electricity removal unit 30 including a grid 301 for voltage adjustment at a position opposite to the drive roller 21 via the belt, measuring an electric current flowing toward the drive roller 21, changing the applied voltage to the grid 301 from a grid power source 31 in accordance with the measured value, and correcting the charge amount of the toner layer to an adequate value (without the toner scattering and density irregularities). Incidentally, the drive roller 21 made of a naked aluminum material is grounded via an ampere meter 210. The detected electric current value is transmitted to the control part B1 to control the applied voltage of the grid 301 so that the optimum applied voltage can be outputted to the pre-secondary-transfer electricity removal unit. In other words, the density irregularities occur when the electricity removal efficiency before secondary transfer is small, and when large, the toner scattering occurs in the thin line portion. Thus, it is required to control the output of the pre-secondary-transfer electricity removal unit 30 so that the optimum electricity removal efficiency can be obtained.

Herein, the confirmation test was carried out for the image quality in relation to the process speed, counter electrode current at the standard electricity removal condition, and grid voltage according to the embodiment, and its description will be made below.

Confirmation Test

Test Conditions

Image forming apparatus: Tandem color image forming apparatus

Pre-secondary-transfer electricity removal unit:

Placed between the last primary transfer and the secondary transfer, and distance between the grid and the intermediate transfer belt=1 mm;

Counter electrode (drive roller) is connected to GND ground Side plate has the same potential as the grid; Applied voltage to the discharge wire is 5 kV Intermediate transfer belt: Made of polyimide, Volume resistance $10^9$ Ω·cm Transfer material: Plain paper (64 g/m$^2$)

Operating environment: Low temperature/low humidity (10° C., 20%)

Under the above conditions, the ampere meter 210 is placed between the counter electrode and GND for measuring the electric current flowing toward the counter electrode (drive roller 21) of the pre-secondary-transfer electricity removal unit 30 to control the applied voltage to the gird 301 by the size of the measured current value.

Test Content

The color irregularities were visually confirmed by changing the process speed at three levels, and changing the applied voltage to the grid 301 to output a superimposed two-layer blue solid image. The toner scattering was also visually confirmed by forming a thin line portion with the single color of C (cyan) on the same image. At the same time, the electric potential of the two-layer blue solid image was also observed by placing an electrometer between the pre-secondary-transfer electricity removal unit and the secondary transfer part.

Test Result

The relations among the electric current flowing toward the counter electrode, the applied voltage to the gird and the image defects were obtained as shown in Table 1.

TABLE 1

Relations among the electric current flowing toward the opposite electrode, applied voltage to the grid and image defects

| Process speed | Current toward the counter electrode at the standard electricity removal condition (4.5 kV) | Grid applied voltage (V) | Two-layer solid toner layer potential after electricity removal (V) | Toner scattering in thin line portion | Color irregularities in two-layer solid portion | Judgment |
|---|---|---|---|---|---|---|
| 110 mm/sec | 9.0 μA | 50 | −65 | D | B | D |
| | | 0 | −80 | D | B | D |
| | | −50 | −100 | D | B | D |
| | | B −100 | −120 | B | B | B |
| | | −150 | −145 | B | D | D |
| 160 mm/sec | 7.5 μA | 50 | −80 | D | B | D |
| | | 0 | −95 | D | B | D |
| | | B −50 | −115 | B | B | B |
| | | B −100 | −130 | B | B | B |
| | | −150 | −165 | B | D | D |
| 220 mm/sec | 6.5 μA | 50 | −90 | D | B | D |
| | | 0 | −110 | B | B | B |
| | | B −50 | −125 | B | B | B |
| | | −100 | −150 | B | D | D |
| | | −150 | −180 | B | D | D |

The following facts can be found from Table 1 that, in the case of over electricity removal, the toner charge amount becomes small and the adherence between the belt and the toner decreases, thereby the toner scattering occurs in characters and thin lines before the secondary transfer nipping part, and in the case of insufficient electricity removal, the total charge of the toner in the two-layer blue solid portion is large due to a large amount of toner charge, so that sufficient secondary transfer efficiency can not be obtained and the color irregularities occur.

Further, it was proved that the applied voltage to the grid (with B mark) which is better for the color irregularities and the toner scattering relative to the electric current in the range of 6.5 to 9.0 μA flowing toward the counter electrode varies, as well as that there is a need to change the applied voltage setting to the grid depending on the electric current flowing toward the counter electrode.

Figure 3:
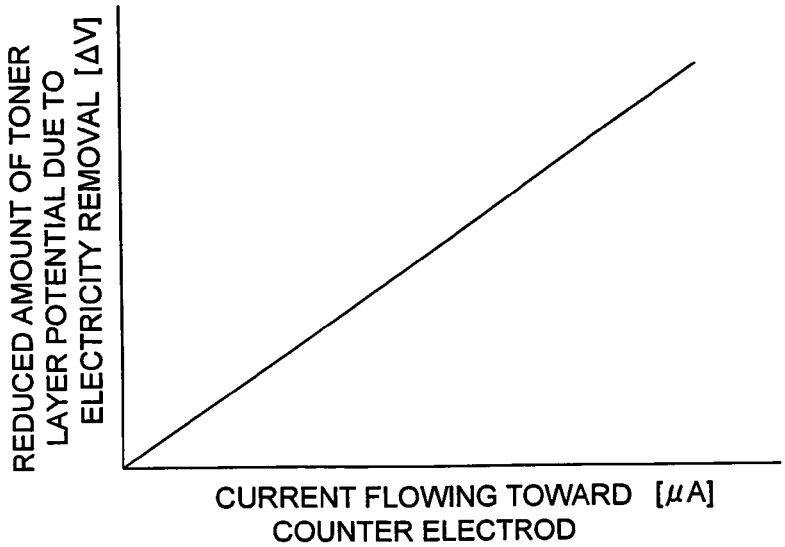
FIG. 3 is a view showing the relation between the reduced amount of the toner layer potential due to the electricity removal and the electric current value flowing toward a counter electrode.

Further, the relation between the current flowing toward the counter electrode and the reduced amount of the toner layer potential due to the electricity removal is proportional to each other as shown in FIG. 3.

FIG. 3 is a view showing the relation between the reduced amount of the toner layer potential due to the electricity removal and the electric current flowing toward the counter electrode.

Consequently, the adequate applied voltages (without the toner scattering and the color irregularities) to be applied to the grid relative to the electric currents flowing toward the counter electrode are stored in the control part B1 as tables as shown in Table 2 based on the data obtained by the test, so that the optimum grid applied voltage can be selected in accordance with the current flowing toward the counter electrode under the operating environment (from low humidity to high humidity) in the image forming. As described above, the gird applied voltage is selected and controlled in accordance with the detected current for electricity removal and humidity, with the electric current values at the extreme left in the tables as the reference values.

TABLE 2

Adequate applied voltage to the grid relative to the electric current toward the counter electrode

| Current toward the counter electrode at the | Grid applied voltage (V) | | |
|---|---|---|---|
| standard electricity removal condition (−50 V) | Low humidity (up to 30%) | (30 to 60%) | High humidity (above 60%) |
| 5 μA or less | 0 | −50 | −100 |
| 5 to 7 μA | −50 | −100 | −120 |
| 7 to 9 μA | −100 | −120 | −150 |
| 9 to 11 μA | −120 | −150 | −150 |
| Above 11 μA | −150 | −150 | −150 |

As described above, it is found that, when the grid voltage is changed and applied, the adequate electric potential of the two-layer solid image varies.

Figure 4:
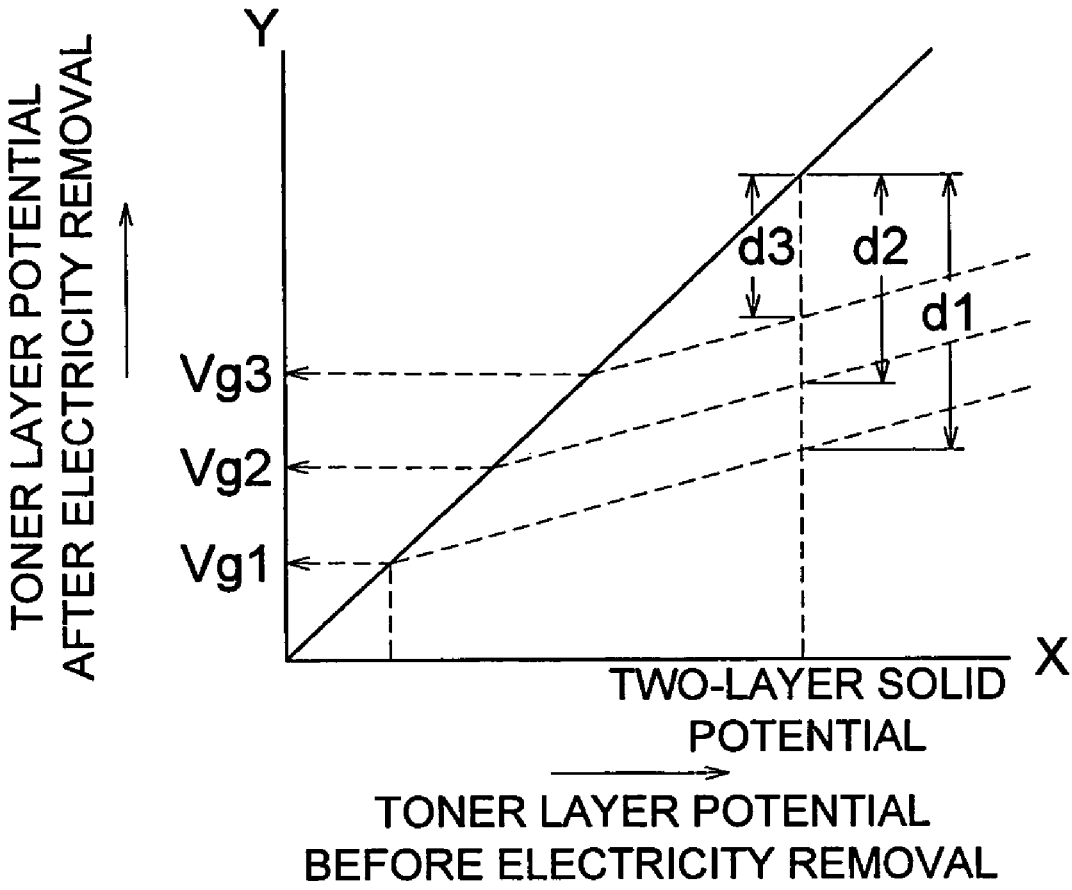
FIG. 4 is a view showing the relation of the toner layer potentials before and after the electricity removal relative to the grid applied voltages.

FIG. 4 is a view showing the relation of the electric potentials in the toner layer before and after the electricity removal relative to the grid applied voltages.

In FIG. 4, when the electricity removal is not carried out, the electric potentials before and after the electricity removal in the two-layer solid image on the intermediate transfer belt are on Y=X, however, taking the grid voltages Vg after the start of the electricity removal, for example, in the case of −50 V, −100 V, and −150 V, the electric potentials after the electricity removal are reduced by d1, d2, and d3 V respectively as compared to those before the electricity removal.

Incidentally, the image forming apparatus of the present embodiment is provided with a CPU, a RAM, a ROM, a non-volatile memory and a hygrometer, and may cause these components to operate as follows.

In the embodiment, during warming up or at the change in the process speed, the CPU calls the adjustment program of the pre-secondary-transfer electricity removal condition stored in the ROM to set up the applied voltage to the grid 301.

The CPU sets the applied voltage to be applied to the grid 301 to the standard electricity removal condition, calls the image pattern for testing stored in the non-volatile memory, and carries out the image forming to form toner images of the test print on the intermediate transfer belt 20. The image pattern for testing as used herein is a high density pattern on which solid images of two colors are superimposed.

Before or after this process, the CPU reads the environmental humidity from the hygrometer to record the detected humidity value in the RAM, and at the same time, the CPU judges the table to be used among the tables for low humidity (up to 30%), intermediate humidity (from 30% to 60%), and high humidity (60% or more) shown in Table 2.

The CPU, using the current value for electricity removal the ampere meter 210 measured at the time when this image pattern for testing passed through the pre-secondary-transfer electricity removal unit 30, calls the table for the humidity condition previously selected from the tables shown in Table 2, defines the grid applied voltage value from the detected current value for electricity removal, and sets the value as the applied voltage value to the grid 301.

By carrying out the above described adjustment program of the pre-secondary-transfer electricity removal condition, a better transfer image without the color irregularities and the toner scattering will be obtained in the subsequent print operation.

After the execution of such an adjustment program of the pre-secondary-transfer electricity removal condition, the CPU accordingly reads the detected humidity from the hygrometer, and checks whether or not the read humidity value is larger than the predetermined humidity difference (30% in the embodiment) from the humidity value previously stored in the RAM to display the message that requires the pre-secondary-transfer electricity removal in an operation/display section (not shown), when the value is larger than the predetermined humidity difference. The operation/display section is an example of an annunciation unit. Further, in the above operation, when the read humidity is larger than the predetermined humidity difference from the humidity value previously stored in the RAM, the CPU may automatically carry out the pre-secondary-transfer electricity removal, instead of displaying the message requiring the pre-secondary-transfer electricity removal toward the operation/display section.

Second Embodiment

Figure 5:
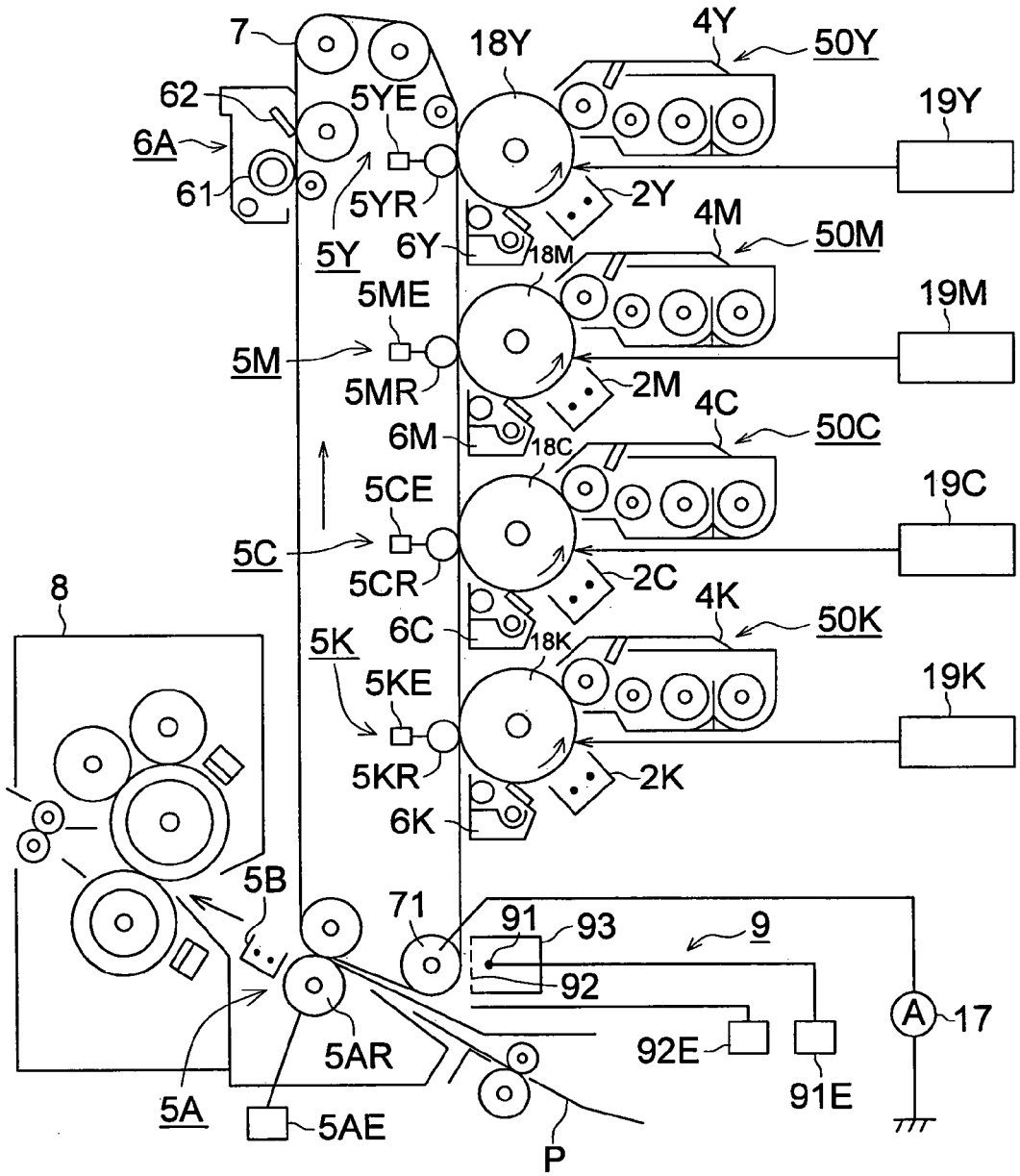
FIG. 5 is a configuration view of a color image forming apparatus.

FIG. 5 is a view showing a color image forming apparatus according to the present embodiment.

This color image forming apparatus is called the tandem color image forming apparatus, and has a plurality of groups of image forming devices 50Y, 50M, 50C, 50K, an intermediate transfer unit, a paper conveyance device and a fixing device 8.

The image forming device 50Y for forming a yellow color image has a charging device 2Y placed around a photoconductor 18Y as an image carrier, an exposure device 19Y, a development device 4Y, a primary transfer unit 5Y, and a cleaning section 6Y. The image forming device 50M for forming a magenta color image has a charging device 2M placed around a photoconductor 18M as an image carrier, an exposure device 19M, a development device 4M, a primary transfer unit 5M, and a cleaning section 6M. The image forming device 50C for forming a cyan color image has a charging device 2C placed around a photoconductor 18C as an image carrier, an exposure device 19C, a development device 4C, a primary transfer unit 5C, and a cleaning section 6C. The image forming device 50K for forming a black color image has a charging device 2K placed around a photoconductor 18K as an image carrier, an exposure device 19K, a development device 4K, a primary transfer unit 5K, and a cleaning section 6K.

A belt-like intermediate transfer member 7 is a semiconducting material which is tightly wound and supported by a plurality of rollers so that the intermediate transfer member 7 can circulate and move.

By an image forming section composed of the charging device 2Y, the exposure device 19Y and the development device 4Y, the processes of charging, exposure and development are carried out relative to the photoconductor 18Y to form a yellow toner image on the photoconductor. Similarly, by an image forming section composed of the charging device 2M, the exposure device 19M and the development device 4M, a magenta toner image is formed on the photoconductor 18M, by an image forming section composed of the charging device 2C, the exposure device 19C and the development device 4C, a cyan toner image is formed on the photoconductor 18C, and by an image forming section composed of the charging device 2K, the exposure device 19K and the development device 4K, a black toner image is formed on the photoconductor 18K. These single-color toner images are transferred and superimposed by the transfer rollers 5Y, 5M, 5C, 5K, respectively, onto the intermediate transfer member 7, thereby a multicolor toner image is formed.

Used herein as the photoconductor 1 is the known one such as an OPC photoconductor or an a-Si photoconductor, of which the OPC photoconductor is preferred, and in particular, the negatively charged OPC photoconductor is preferred, so that the negatively charged OPC is used in the embodiment.

Used herein as the charging device 2 is the corona discharge device such as a scorotron or corotron, of which the scorotron discharge device is preferably used.

Used herein as the exposure device is the light emitting element such as a laser or an LED array that emit light according to the image data.

Used herein as the development device 4 is a development device using a two-component developer with a carrier and toner as the main components, or a development device using a mono-component developer with a toner as the main component without containing a carrier, and the two-component development device using the toner having a small particle diameter is preferred. Further, the one that carries out the normal development or the one that carries out the reversal development can be used for the development device, and the reversal development is preferred that applies the development bias voltage with the same polarity as the charge of the photoconductor 1 to a developing sleeve 4*a*, and carries out development with the toner charged in the same polarity as the photoconductor charge, thus the development is carried out by the reversal development using the negatively charged toner in the embodiment.

As for the toner having a small particle diameter, it is preferable that the volume average particle diameter is in the range of 3 to 6 μm.

The volume average particle diameter is the average particle diameter on a volume basis, measured by "Coulter Counter TA-II" or "Coulter Multisizer" (both manufactured by Coulter Co. Ltd.) that are equipped with a wet type homogenizer.

With such a toner having the small particle diameter, a high quality image having high resolving power can be formed. The high image quality characteristic is weakened with the toner having a volume average particle diameter larger than 6 μm.

When using the toner having a volume average particle diameter smaller than 3 μm, the image quality degradation due to fogging or other defects is likely to occur.

Further, a sphere toner is preferred in the embodiment, and it is preferable that its sphericity is 0.94 or more and 0.98 or less.

The sphericity, expressed by sphericity=(the perimeter of the circle having the same area as the particle projection image)/(the perimeter of the particle projection image), can be calculated by taking pictures for 500 resin particles with being enlarged 500 times by a scanning electron microscope or a laser microscope, analyzing the picture images using the image analyzer "SCANNING IMAGE ANALYSER" (manufactured by Nippon Denshi Co. Ltd.) to measure the aspect ratio, and determining its arithmetic average value. More simple measuring method can be provided by using "EPIA-1000" (manufactured by TOA Medical Electronics Co., Ltd).

When the sphericity is smaller then 0.94, the toner is strongly stressed within the development device, and as a result, the toner is crushed and the fogging or toner scattering is likely to occur. When the sphericity is larger than 0.98, it is sometimes difficult to keep the cleaning performance high.

It is preferable to use a polymerized toner for the toner having the small particle diameter and high sphericity as described above.

The polymerized toner refers to the toner in which the generation of the binder resin for toner and the toner shape can be formed and obtained by the polymerization of the material monomer of the binder resin or the pre-polymer, and the subsequent chemical-processing. More particularly, it refers to the toner that can be obtained through the polymerization reaction, such as the suspension polymerization or emulsion polymerization, and the subsequent fusion process of the particles themselves according to the necessity. In the case of the polymerized toner, the material monomer or pre-polymer is first dispersed in the water system and then the dispersion is polymerized to produce the toner, so that the toner having a uniform particle distribution and shape can be obtained.

More particularly, the polymerized toner can be produced by the suspension polymerization method, or by the method of producing fine polymerized particles by emulsifying and polymerizing the monomer in a liquid of water system medium with the emulsified liquid added therein, followed by adding an organic medium, a coagulant and the like to aggregate the particles. There may be enumerated a method of preparing a toner by mixing and aggregating with a dispersion of a mold releasing agent, coloring agent and the like necessary for the toner composition in the aggregation, or a method of preparing a toner by dispersing the toner components including the mold releasing agent, coloring agent and the like in the monomer, followed by emulsifying and polymerizing. Herein, the aggregation refers to that a plurality of resin particles and coloring agent particles are fused together.

Reference numeral 5A denotes a secondary transfer unit provided with transfer rollers 5AR composed of conductive rubber rollers and a power source 5AE, and in the embodiment, the secondary transfer unit applies a bias voltage of +5 kV to transfer the toner image on the intermediate transfer member 7 onto the transfer material.

The intermediate transfer member 7, which is a single-layer or multi-layer belt made of polyimide and the like as material, is used with the volume resistivity in the range of $10^7$ to $10^{12}$ Ω·cm, and in the embodiment, with the volume resistivity of $10^9$ Ω·cm.

Reference numeral 6A denotes an intermediate transfer member cleaning section for cleaning the intermediate transfer member 7, reference numeral 8 denotes a fixing device for fixing the toner image onto the transfer material P.

After the toner image has been secondarily transferred by the transfer rollers 5A, the intermediate transfer member 7 is cleaned by passing through the intermediate transfer member cleaning section 6A.

Reference numeral 9 denotes a pre-secondary-transfer electricity removal unit (hereinafter, also referred to as only an electricity removal unit), which is composed of a scorotron charger and has a discharge electrode 91 and a grid 92.

The color image forming apparatus of the embodiment has an electricity removal unit 9 provided between the primary transfer unit 5K and secondary transfer unit 5A along the intermediate transfer member 7, wherein the grid 92 is opposed to the belt surface of the intermediate transfer member 7. In the embodiment, the grid 92 is opposed thereto at an interval of 1 mm. Provided behind the intermediate transfer member 7 is a support roller 71 grounded as the counter electrode via the ampere meter 17.

The discharge electrode 91 is set with a DC applied voltage for carrying out discharge with reverse polarity to the toner, and the grid 92 and the side plate are set with an applied voltage so that the electric potential would be between the surface potential in the maximum toner density on the intermediate transfer member 7 and the surface potential at a portion of the intermediate transfer member on which the toner does not adhere, wherein these applied voltages are controlled in accordance with the change in the current for electricity removal, which reflects the change in the electricity removal efficiency.

Figure 6:
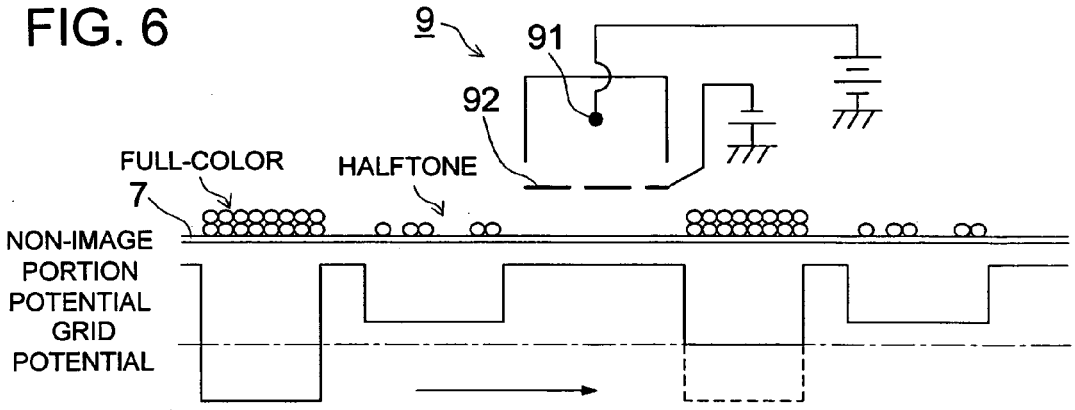
FIG. 6 is a schematic view showing the change of the toner layer potentials before and after the passage through the electricity removal unit.

FIG. 6 is a schematic view showing the variation of the electric potential in the toner layer on the intermediate transfer member 7 before and after passing through the electricity removal unit 9 with the applied voltage applied thereto. The figure shows that the electric potential at the full-color portion having a high toner adhering amount voltage decreases, but the electric potential of the half-tone portion having a low toner adhering amount voltage is maintained as it is. Because of such a control, the toner charge at the high toner adhering portion in which the potential is higher than the grid potential decreases to improve the secondary transfer performance, as well as the toner charge at the low toner adhering portion in which the potential is lower than the grid potential does not decrease, so that the electricity removal processing with the improved transfer condition is carried out.

However, the efficiency of removing the toner layer charge varies depending on the environment and the system speed, so that in the embodiment, the change in the electricity removal efficiency is detected by the ampere meter 17 with the current for electricity removal flowing toward the support roller 71 which is the counter electrode in the electricity removal unit, and the applied voltage to the discharge electrode (wire) 91 is changed in accordance with the change in the detected current for electricity removal.

Figure 7:
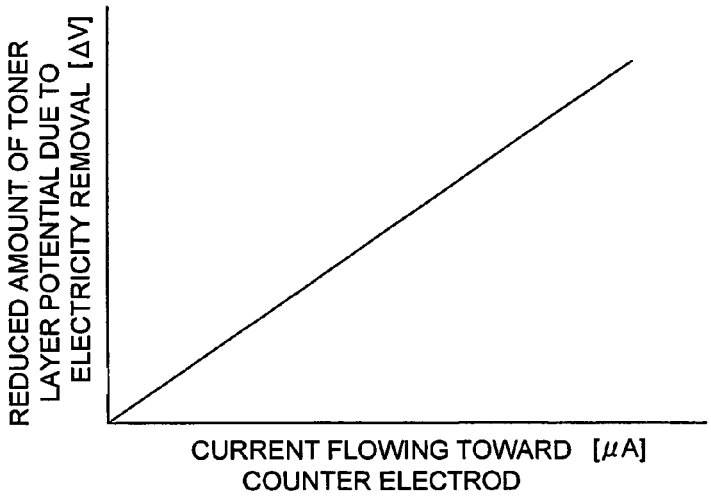
FIG. 7 is a graph showing the relation between the electric current flowing toward the counter electrode and the reduced amount of the toner layer potential due to the electricity removal.

FIG. 7 shows that the relation between the electric current flowing toward the counter electrode detected by the ampere meter 17 and the reduced amount of the toner layer potential due to the electricity removal is proportional to each other.

The present inventers tested, under the environment of low temperature/low humidity (10° C., RH 20%), using the color image forming apparatus shown in FIG. 5, the relations among the current for electricity removal flowing toward the counter electrode, the applied voltage to the discharge electrode 91 and the image defects, by setting the gird applied voltage to −50 V, and changing the process speed at three levels to control the applied voltage to the discharge electrode 91 (using a 60 μm tungsten wire).

Incidentally, when carrying out the test, the inventers outputted a superimposed solid image onto the recording paper (64-g paper) with the back side being blue, and transferred by setting the applied voltage to the transfer rollers 5A to +5 kV, thereby to visually confirm the color irregularities. Further, they created a thin line portion of the single color of cyan on the same image to confirm and estimate the toner scattering state. At the same time, they monitored the electric potential of the two-layer solid image by placing the ampere meter (not shown) between the electricity removal unit 9 and the secondary transfer unit 5A. Incidentally, the electric potential of the two-layer solid toner layer was −190 V when the electricity removal was not carried out.

TABLE 3

| Process speed | Current toward the counter electrode at the standard electricity removal condition (4.5 kV) | Wire applied voltage value (kV) | Two-layer solid toner layer potential after electricity removal (V) | Toner scattering in thin line portion | Color irregularities in two-layer solid portion | Judgment |
|---|---|---|---|---|---|---|
| 110 mm/sec | 9.0 μA | 5.5 | −70 | D | B | D |
| | | 5 | −80 | D | B | D |
| | | 4.5 | −100 | D | B | D |
| | | 4 | −120 | B | B | B |
| | | 3.5 | −145 | B | D | D |
| 160 mm/sec | 7.5 μA | 5.5 | −80 | D | B | D |
| | | 5 | −95 | D | B | D |
| | | 4.5 | −115 | B | B | B |
| | | 4 | −130 | B | B | B |
| | | 3.5 | −165 | B | D | D |
| 220 mm/sec | 6.5 μA | 5.5 | −90 | D | B | D |
| | | 5 | −110 | B | B | B |
| | | 4.5 | −125 | B | B | B |
| | | 4 | −150 | B | D | D |
| | | 3.5 | −180 | B | D | D |

It is apparent from Table 3 that, under the standard electricity removal condition, the current value flowing toward the counter electrode varies in accordance with the process speed. It is also proved that the applied voltage value to be applied to the discharge electrode (wire) 91 varies such that both of the toner scattering and the color irregularities are improved, relative to the electric current of 6.5 to 9.0 μA flowing toward the counter electrode.

In other words, it shows that the adequate applied voltage to be applied to the discharge electrode (wire) 91 relative to the current for electricity removal of 9.0 μA is 4 kV, relative to the current for electricity removal of 7.5 μA is 4 kV or 4.5 kV, and relative to the current for electricity removal of 6.5 μA is 4.5 kV or 5 kV. From this test result, it was proved that changing the applied voltage setting to the discharge electrode (wire) 91 in accordance with the current value for electricity removal flowing toward the counter electrode and being detected by the ampere meter 17, is required to obtain the image without the toner scattering in the thin line portion and the color irregularities.

Incidentally, in the above test, the toner scattering in the thin line portion occurs with the over removal of electricity, because the toner charge amount becomes smaller and the adherence between the intermediate transfer member 7 and the toner diminishes, causing the toner scattering before the secondary transfer nipping. Further, the color irregularities in the two-layer solid portion are caused by the fact that when the electricity removal is insufficient, the total charge amount of the two-layer solid portion increases due to the large amount of toner charge, and thereby the sufficient secondary transfer efficiency can not be obtained.

The present embodiment has an adjustment mode. This mode is for carrying out the adjustment by forming an image for testing (a patch image), not for carrying out the image forming. The adjustment mode sets the applied voltage to be applied to the discharge electrode (wire) 91, from the current value for electricity removal of the toner image for testing, which is detected by the ampere meter 17, using Table 4 of the adequate applied voltage to the discharge electrode (wire) 91. According to Table 4, the discharge electrode applied voltage is selected and controlled in accordance with the detected current for electricity removal and the humidity, based on the electric current values shown at the extreme left.

TABLE 4

| Current toward the counter electrode at | Wire applied voltage value (kV) | | |
|---|---|---|---|
| the standard electricity removal condition (4.5 V) | Low humidity (up to 30%) | Intermediate humidity (30 to 60%) | High humidity (above 60%) |
| to 5 μA | 5 | 4.5 | 4 |
| to 7 μA | 4.5 | 4 | 3.7 |
| to 9 μA | 4 | 3.7 | 3.5 |
| to 11 μA | 3.7 | 3.5 | 3.5 |
| 11 μA to | 3.5 | 3.5 | 3.5 |

Figure 8:
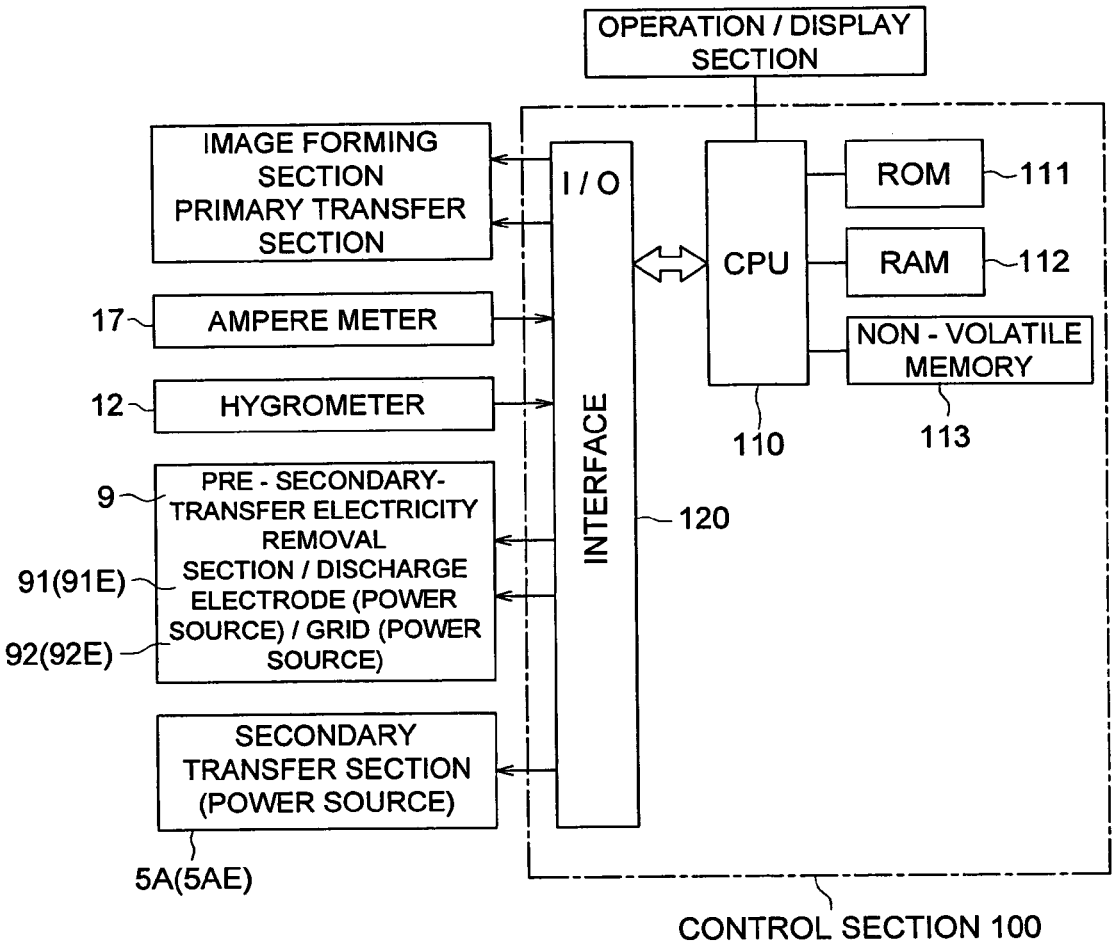
FIG. 8 is a block diagram showing the outline of an electrical control system.

FIG. 8 is a block diagram showing the outline of an electric control system. Reference numeral 110 denotes a CPU for carrying out the arithmetic control processing, to which a ROM 111, a RAM 112 and a non-volatile memory 113 are connected respectively. The ROM 111 stores, in addition to the operation basic data, an image forming mode program, an adjustment program of the pre-secondary-transfer electricity removal condition and the like, and the non-volatile memory 113 stores the tables indicating the relations among the current for electricity removal, humidity, and applied voltage to the wire shown in Table 4. The CPU 110 is connected to an external device via an interface 120.

In the input side of the interface 120, the ampere meter 17 for detecting the current for electricity removal, the hygrometer 12 placed within the apparatus and measuring the environmental humidity and other instruments are connected to an input board respectively. In the output side of the interface 120, in addition to the image forming units, a grid power source 92E of the electricity removal unit 9, a power source 91E of the discharge electrode 91, a power source 5AE of the secondary transfer unit 5A and the like are connected to an output port respectively.

The color image forming apparatus shown in FIG. 5 is provided with the operation/display section in which the process speed is set, the size and print number of the recording paper to be used are inputted, and the start button for instructing the start of the print operation is pushed, subsequently the CPU 110 calls the image forming mode program from the ROM 111 to carry out the image forming of the established number of sheets for the image data stored in the memory at the established process speed.

In the embodiment, during warning up or at the change in the process speed, the CPU 110 calls the adjustment program of the pre-secondary-transfer electricity removal condition stored in the ROM 111 to set the applied voltage to the discharge electrode (wire) 91.

The CPU 110 sets the applied voltage to be applied to the discharge electrode (wire) 91 to the standard electricity removal condition of +4.5 kV, and calls the image pattern for testing stored in the non-volatile memory 113 to carry out the image forming, thereby forms toner images of the test print on the intermediate transfer member 7. Used herein as the image pattern for testing is a high density pattern on which the solid images of two colors are superimposed.

Before or after this process, the CPU 110 reads the environmental humidity from the hygrometer 12 and records the detected humidity value in the RAM 112, and at the same time, judges the table to be used among the tables for low humidity (up to 30%), intermediate humidity (from 30% to 60%) and high humidity (60% or more) shown in Table 4.

The CPU 110, using the current value for electricity removal the ampere meter 17 measured at the time of the image pattern for testing passing through the electricity removal unit 9, calls the table for the humidity condition previously selected from the tables shown in Table 4, defines the wire applied voltage value from the detected current value for electricity removal, and sets the value as the applied voltage value to the discharge electrode (wire) 91.

By carrying out the above described adjustment program of the pre-secondary-transfer electricity removal condition, the better transferred image without the color irregularities and toner scattering can be obtained in the subsequent print operation.

After the execution of such an adjustment program of the pre-secondary-transfer electricity removal condition, the CPU 110 accordingly reads the humidity detected by the hygrometer 12 to check whether the read humidity value is lager than the predetermined humidity difference (30% in the embodiment) from the humidity previously recorded in the RAM 112, and when larger than the predetermined humidity value, the CPU 110 displays a message that requires the adjustment of the pre-secondary-electricity removal condition in the operation/display section. The operation/display section is an example of an annunciation unit. Also, in the above operation, the read humidity is larger than the predetermined humidity difference from the humidity value previously recorded in the RAM 112, the CPU may automatically carry out the adjustment program of the pre-secondary-transfer electricity removal condition, instead of displaying the message of requiring the adjustment before secondary transfer toward the operation/display section. The operation/display section works as a annunciation unit.

While the preferred embodiments of the present invention have been described using specific terms, such description is for illustrative purposes only, and it is to be understood that changes and variations may be made without departing from the spirit or scope of the appended claims.

By carrying out the adjustment before secondary transfer in accordance with the display, the user can obtain the better transferred image without the color irregularities and toner scattering, in all of the print operations, regardless of the change in the environmental humidity.

What is claimed is:

1. A color image forming apparatus, comprising:

an image forming unit composed of a plurality of groups which have image carriers and image forming devices, wherein the image forming devices provided around the image carrier forms a toner image on the image carrier;

an intermediate transfer member which is surrounded by the plurality of groups;

a primary transfer unit for transferring the toner image on the image carrier onto the intermediate transfer member to form an superimposed toner image;

a secondary transfer unit which is provided at the downstream of the intermediate transfer member from the primary transfer unit, and transfers the superimposed toner image onto a transfer material;

an electricity removal unit which has a discharge electrode and a grid electrode, and is provided between the primary transfer unit and the secondary transfer unit;

a discharge electrode power source for applying a DC voltage with reverse polarity to the toner image on the intermediate transfer member to the discharge electrode;

a grid electrode power source for applying a DC voltage with the same polarity as the toner image on the intermediate transfer member to the grid electrode;

a counter electrode which is provided facing the electricity removal unit;

a current detecting unit for detecting an electricity removal current flowing through the counter electrode, and a control unit for controlling an output of the electricity removal unit in accordance with a value of the electricity removal current detected by the current detecting unit.

2. The color image forming apparatus according to claim 1, wherein the control unit controls the electricity removal unit by controlling an applied voltage applied to the grid electrode in accordance with the value of the electricity removal current detected by the current detecting unit.

3. The color image forming apparatus according to claim 1, wherein the control unit controls the electricity removal unit by controlling an applied voltage applied to the discharge electrode in accordance with the value of the electricity removal current detected by the current detecting unit.

4. The color image forming apparatus according to claim 1, wherein the control unit controls the output of the electricity removal unit comparing the value of the electricity removal current detected by the current detecting unit and a reference current value.

5. The color image forming apparatus according to claim 4, wherein the control unit sets the reference current value in accordance with a process speed of the color image forming apparatus.

6. The color image forming apparatus according to claim 4, wherein the control unit sets the reference current value in accordance with an operating environment of the color image forming apparatus.

7. The color image forming apparatus according to claim 1, wherein the counter electrode is grounded through the current detecting unit.

8. The color image forming apparatus according to claim 2, further comprising an adjustment mode, wherein in the adjustment mode, the image forming unit forms a toner image for testing on the intermediate transfer member and the control unit controls the applied voltage applied to the grid electrode in accordance with the value of the electricity removal current detected by the current detecting unit.

9. The color image forming apparatus according to claim 3, further comprising an adjustment mode, wherein in the adjustment mode, the image forming unit forms a toner image for testing on the intermediate transfer member and the control unit controls the applied voltage applied to the discharge electrode in accordance with the value of the electricity removal current detected by the current detecting unit.

10. The color image forming apparatus according to claim 8, wherein when a process speed of the color image forming apparatus changes, the control unit adjusts the applied voltage applied to the grid electrode by executing the adjustment mode.

11. The color image forming apparatus according to claim 9, wherein when a process speed of the color image forming apparatus changes, the control unit adjusts the applied voltage applied to the discharge electrode by executing the adjustment mode.

12. The color image forming apparatus according to claim 1, wherein the electricity removal unit is of a scorotron type.

13. The color image forming apparatus according to claim 1, further comprising a humidity sensor for sensing humidity, wherein the control unit controls the output of the electricity removal unit in accordance with the value of the electricity removal current detected by the current detecting unit and a humidity detected by the humidity sensor.

14. The color image forming apparatus according to claim 8, further comprising a humidity sensor for sensing humidity and an annunciation unit for annunciating, wherein the annunciation unit annunciates to urge to execute the adjustment mode when a humidity sensed by the humidity sensor is higher than a predetermined value.

15. The color image forming apparatus according to claim 9, further comprising a humidity sensor for sensing humidity and an annunciation unit for annunciating, wherein the annunciation unit annunciates to urge to execute the adjustment mode when a humidity sensed by the humidity sensor is higher than a predetermined value.

16. The color image forming apparatus according to claim 8, further comprising a humidity sensor, wherein the control unit executes the adjustment mode to adjust the output of the electricity removal unit when a humidity sensed by the humidity sensor is higher than a predetermined value.

17. The color image forming apparatus according to claim 9, further comprising a humidity sensor, wherein the control unit executes the adjustment mode to adjust the output of the electricity removal unit when a humidity sensed by the humidity sensor is higher than a predetermined value.

18. The color image forming apparatus according to claim 8, further comprising a humidity sensor, an annunciation unit and a humidity memory unit for memorizing humidity when the previous adjustment mode was executed, wherein the control unit controls the humidity sensor to sense humidity, and calculates a difference between the humidity memorized in the humidity memory unit and the humidity sensed by the humidity sensor, and then when the difference is greater than a predetermined value, the annunciation unit annunciates to urge to execute the adjustment mode.

19. The color image forming apparatus according to claim 9, further comprising a humidity sensor, an annunciation unit and a humidity memory unit for memorizing humidity when the previous adjustment mode was executed, wherein the control unit controls the humidity sensor to sense humidity, and calculates a difference between the humidity memorized in the humidity memory unit and the humidity sensed by the humidity sensor, and then when the difference is greater than a predetermined value, the annunciation unit annunciates to urge to execute the adjustment mode.

20. The color image forming apparatus according to claim 8, further comprising a humidity sensor and a humidity memory unit for memorizing humidity when the previous adjustment mode was executed, wherein the control unit controls the humidity sensor to sense humidity, and calculates a difference between the humidity memorized in the humidity memory unit and the humidity sensed by the humidity sensor, and then when the difference is greater than a predetermined value, the control unit executes the adjustment mode to adjust the output of the electricity removal unit.

21. The color image forming apparatus according to claim 9, further comprising a humidity sensor and a humidity memory unit for memorizing humidity when the previous adjustment mode was executed, wherein the control unit controls the humidity sensor to sense humidity, and calculates a difference between the humidity memorized in the humidity memory unit and the humidity sensed by the humidity sensor, and then when the difference is greater than a predetermined value, the control unit executes the adjustment mode to adjust the output of the electricity removal unit.

* * * * *